US005873278A

United States Patent [19]

Saegusa

[11] Patent Number: 5,873,278

[45] Date of Patent: Feb. 23, 1999

[54] MULTI-ROW PIPE BENDING APPARATUS

[75] Inventor: Shigeru Saegusa, Shizuoka, Japan

[73] Assignee: Usui Kokusai Sangyo Kaisha Limited, Japan

[21] Appl. No.: 854,121

[22] Filed: May 9, 1997

[30] Foreign Application Priority Data

May 17, 1996 [JP] Japan ..... 8-148459

[51] Int. Cl.[6] ..... B21D 7/022

[52] U.S. Cl. ..... 72/306; 72/149; 72/159

[58] Field of Search ..... 72/307, 306, 217, 72/219, 149, 157, 158, 388

[56] References Cited

U.S. PATENT DOCUMENTS

| | | | |
|---|---|---|---|
| 4,563,802 | 1/1986 | Benteler | 72/307 |
| 4,662,204 | 5/1987 | Saegusa | 72/306 |
| 4,732,025 | 3/1988 | Marlinga et al. | 72/150 |
| 4,735,075 | 4/1988 | Saegusa | 72/306 |
| 4,805,436 | 2/1989 | Saegusa | 72/306 |
| 4,945,747 | 8/1990 | Yogo | 72/306 |
| 4,959,984 | 10/1990 | Trudell et al. | 72/150 |
| 5,197,320 | 3/1993 | Saegusa | 72/307 |
| 5,305,223 | 4/1994 | Saegusa | 72/149 |
| 5,483,809 | 1/1996 | Nishiie et al. | 72/150 |
| 5,499,522 | 3/1996 | Schwarze | 72/157 |
| 5,566,565 | 10/1996 | Saegusa | 72/306 |

FOREIGN PATENT DOCUMENTS

| | | | |
|---|---|---|---|
| 2353028 | 6/1974 | Germany | 72/306 |
| 1024 | 1/1984 | Japan | 72/217 |

*Primary Examiner*—Daniel C. Crane
*Attorney, Agent, or Firm*—Anthony J. Casella; Gerald E. Hespos; Ludomir A. Budzyn

[57] ABSTRACT

A multi-row pipe bending apparatus has a plurality of rows of pipe bending devices each including a pipe bending unit having at least one bending die, and clamping and pressure dies for securing to the bending die a pipe to be bent. Each bending device includes also a pipe twisting unit having a twisting plate having an opening for holding the pipe, and rotatable with a predetermined twisting angle about the longitudinal axis of the pipe for moving it to a position conforming to the shape into which it is to be bent. The bending and twisting units are movable longitudinally of the pipe. A pipe transfer device is provided for transferring the pipe from one row to another, so that the pipe may be bent close to one end thereof in one row, and close to the other end in another.

9 Claims, 14 Drawing Sheets

MULTI-ROW PIPE BENDING APPARATUS

BACKGROUND OF THE INVENTION

1. Field of the Invention

This invention relates to an apparatus for bending mainly a long pipe having a small diameter.

2. Description of the Prior Art

A known bending apparatus of this type usually has a twisting unit for holding a pipe and rotating it on its longitudinal axis to predetermine the direction in which it is to be bent, and a bending unit, or units situated on one or both sides of the twisting unit for bending the pipe in the predetermined direction.

When the apparatus is used for bending a pipe at one point after another progressively starting at a point close to one end thereof, however, any previously bent portion of the pipe is twisted again when it is going to be bent at another point. The apparatus has, therefore, the drawback of causing any such bent portion of the pipe to collapse if the pipe has a small wall thickness and a large length. Its use is, therefore, limited to a relatively short pipe having a relatively large diameter and wall thickness.

Another problem is due to the fact that the twisting unit is fixed in position. If the twisting unit has its chuck position not corresponding to the middle portion of a pipe, its chuck position has to be altered; otherwise, the apparatus can be used for bending only a very short pipe.

In order to solve these problems, the applicant of this application has previously proposed a pipe bending apparatus comprising a chuck unit for holding a straight pipe at any point thereof, and a transversely movable bending unitsituated on at least one side of the chuck unit, in which the bending unit comprises a support having a guide groove formed at its top for setting a pipe to be bent, a rotor mounted on the support rotatably within an angle of 360 degrees in a direction perpendicular to the longitudinal axis of the pipe, and having a guide groove formed in its wall surface and similar to the guide groove of the support, a and a motor-driven roller type bending device attached to the rotor rotatably for predetermining the direction in which the pipe is to be bent (Japanese Patent Publication No. Hei 8-9063).

The proposed apparatus, however, fails to achieve a high twisting speed, since its bending unit has a large mass. If the apparatus has to be adapted to bend a pipe to form a plurality of bends having different radii of curvature, its bending unit has a still larger mass, since it is necessary to incorporate in the rotor a mechanism for moving a plurality of bending and clamping dies as required by the bends to be formed. The increase in size or mass of the bending unit results not only in the restriction of the shape of the bend to be formed, but also in a further reduction of the twisting speed. Any forced increase of the twisting speed brings about the vibration of the apparatus which shortens its life and disables it to form an accurately shaped bend.

SUMMARY OF THE INVENTION

Under these circumstances, it is an object of this invention to provide an improved pipe bending apparatus which has an improved pipe twisting speed, and can accurately and efficiently bend a pipe into any shape without limitation even when forming a plurality of bends having different radii, and even when bending a long pipe. This object is essentially attained by a multi-row pipe bending apparatus which comprises a plurality of rows of bending devices which are successively used for bending a pipe in different portions thereof, as it is transferred from one row to another, each row comprising a bending unit having pipe bending and clamping dies, and a twisting unit for predetermining the direction in which the pipe is to be bent.

The multi-row pipe bending apparatus of this invention comprises a plurality of rows of pipe bending devices each comprising a pipe bending unit having at least one bending die, and clamping and pressure dies for securing a pipe to the bending die, the bending unit being movable longitudinally of the pipe, and a pipe twisting unit having a twisting plate having an opening for holding the pipe, and rotatable with a predetermined twisting angle about the longitudinal axis of the pipe for moving it to a position conforming to the shape into which it is to be bent, each row further including a pipe transfer device for transferring the pipe to another row, so that the pipe may be bent close to one end thereof in one row of the apparatus, and close to the other end in another row. According to a preferred aspect of the apparatus, each pipe bending unit includes a plurality of bending dies adapted for a plurality of shapes into which the pipe is to be bent, a mechanism for the vertical positioning of each bending die, and a mechanism for its horizontal positioning.

If the apparatus has two rows of bending devices, the pipe to be bent is first fed to the bending device in the first row, held by its bending and twisting units, and bent close to one end thereof. Then, the pipe is transferred to the bending device in the second row by the pipe transfer device, and is bent close to the other end thereof. The apparatus may include still another row or rows of bending devices for bending the pipe in a still different way.

The bending and twisting units in each row are moved by motors back and forth along a platform, and the pipe to be bent is rotated by the twisting unit into the position in which it is to be bent. As soon as the pipe is secured to the bending die by the clamping and pressure dies, the clamping die is rotated to bend it. In the event that the bending device has a plurality of bending dies, the right bending die is selected by the vertical and horizontal positioning mechanisms, and the pipe is secured to the selected die, and is bent as described.

The twisting unit has a mechanism, including a twisting motor, for chucking the pipe and rotating it into the direction in which it is to be bent. It has a pipe transfer device on both sides thereof. The pipe transfer device comprises an arm-shaped pipe chuck, a mechanism for moving the chuck vertically and a mechanism for rotating the chuck, and has the function of receiving a pipe to be bent and transferring it to the bending device in another row and the function of discharging a bent pipe from the apparatus.

When a pipe is bent, the twisting unit is movable toward the bending unit to allow any axial movement of the pipe. When a pipe is bent in one row, the twisting unit in another row can be moved beforehand to the position in which it is expected to receive the pipe from the preceding row.

DETAILED DESCRIPTION OF THE PREFERRED EMBODIMENTS

A two-row pipe bending apparatus embodying this invention is shown in FIGS. 1 to 14, and comprises a pipe bending device 2 in the first row and a pipe bending device 3 in the second row which are mounted on a common platform 1 in an appropriately juxtaposed and spaced apart relation to each other. The pipe bending device 2 in the first row comprises a No. 1 bending unit 2*a* and a No. 1 twisting unit 2*b*, while the pipe bending device 3 in the second row comprises a No. 2 bending unit 3*a* and a No. 2 twisting unit 3*b* having a pipe transfer device 3*c*. The bending and twisting units in each pipe bending device are movable along the longitudinal axis of the pipe P to be bent. No. 1 and No. 2 bending units 2*a* and 3*a* are symmetric to each other in construction, and No. 1 and No. 2 twisting units 2*b* and 3*b* are of the same construction except that No. 2 twisting unit 3*b* has the pipe transfer device 3*c*.

No. 1 and No. 2 bending units 2*a* and 3*a* are mounted on the platform 1 movably along the longitudinal axis of the pipe P, and are each movable back and forth by a motor $M_1$-1 or $M_2$-1 mounted on a unit body 2*a*-1 or 3*a*-1, and a rack and pinion mechanism. The bending unit 2*a* or 3*a* includes a horizontally movable block 2*a*-2 or 3*a*-2 mounted transversely movably on a horizontal positioning mechanism 2*a*-3 or 3*a*-3 attached to the unit body 2*a*-1 or 3*a*-1, a vertically movable block 2*a*-4 or 3*a*-4 supported by a vertical positioning mechanism 2*a*-5 or 3*a*-5 on the horizontally movable block 2*a*-2 or 3*a*-2, and a bending die 2*a*-8 or 3*a*-8, a clamping die 2*a*-9 or 3*a*-9 and a pressure die 2*a*-10 or 3*a*-10 for receiving a reaction force of bending which are mounted on a supporting plate 2*a*-6 or 3*a*-6 attached to the vertically movable block 2*a*-4 or 3*a*-4.

If each bending unit has only a single bending die, and if the clamping die has a smooth outer surface having no annular groove, it is not always necessary that the unit include the horizontal or vertical positioning mechanism 2*a*-3 or 3*a*-3, or 2*a*-5 or 3*a*-5.

Figure 5:
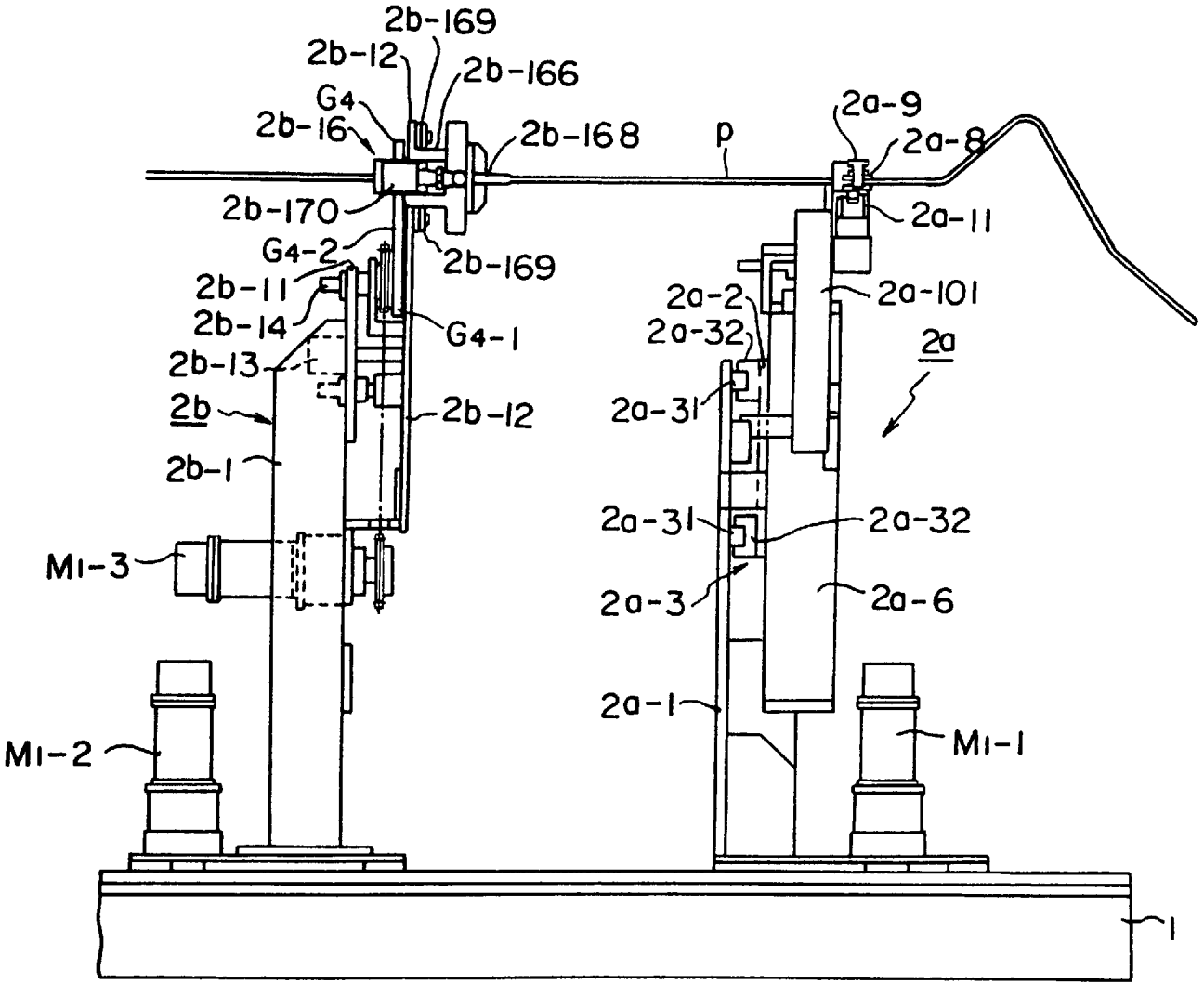
FIG. 5 is a side elevational view of the bending device in the first row as shown in FIG. 3.
Figure 6:
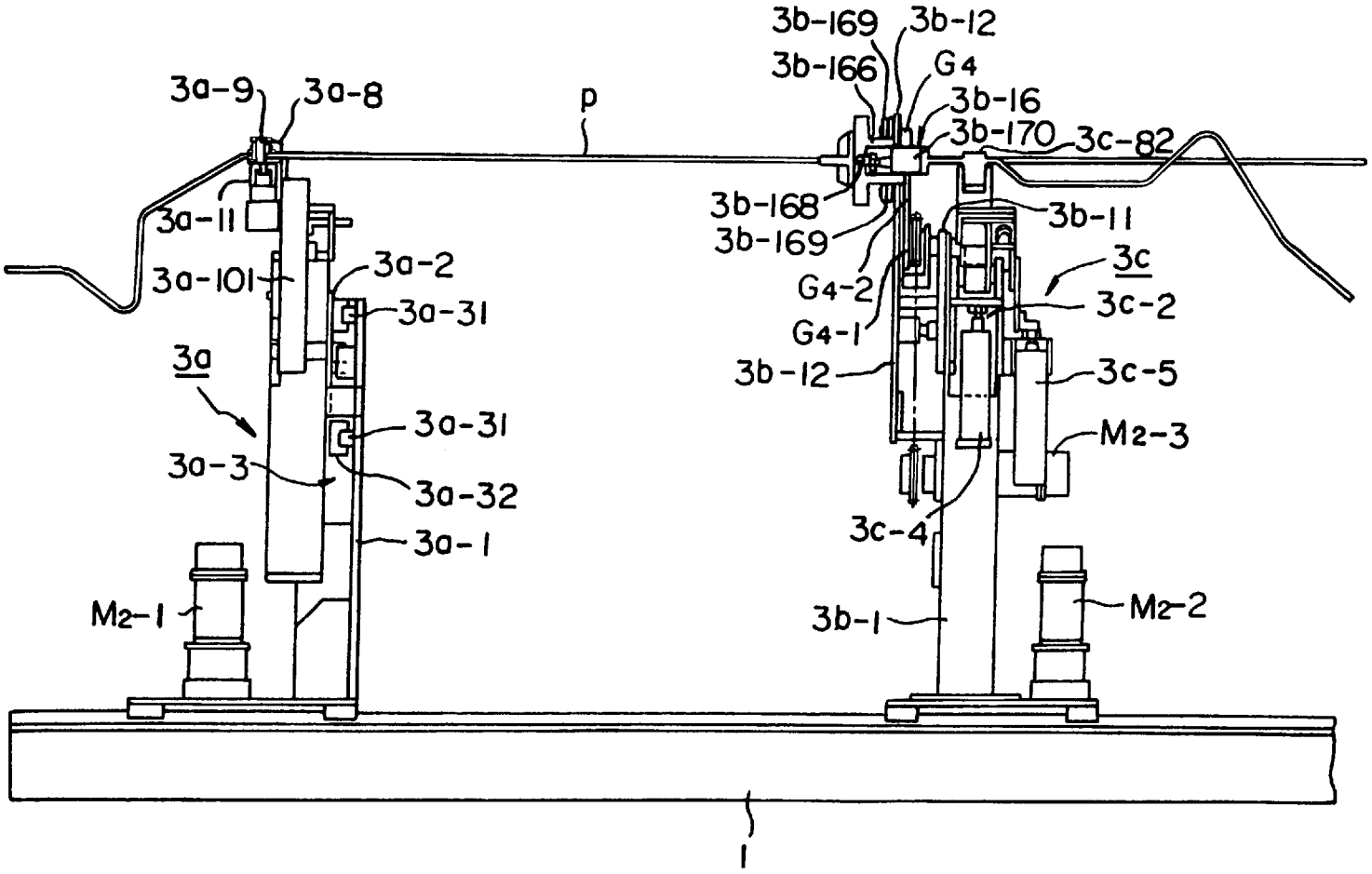
FIG. 6 is a side elevational view of the pipe bending device in the second row as shown in FIG. 4.

The unit body 2*a*-1 or 3*a*-1 has a pair of horizontally extending and vertically spaced apart rails 2*a*-31 or 3*a*-31 and the horizontally movable block 2*a*-2 or 3*a*-2 has a pair of protrusions 2*a*-32 or 3*a*-32 fitted slidably on the rails 2*a*-31 or 3*a*-31, whereby the block 2*a*-2 or 3*a*-2 is suspended from the unit body, as shown in FIG. 5. The horizontal positioning mechanism 2*a*-3 or 3*a*-3 for the horizontally movable block 2*a*-2 or 3*a*-2 comprises a horizontal positioning cylinder 2*a*-33 or 3*a*-33 mounted on the unit body 2*a*-1 or 3*a*-1 for moving the block 2*a*-2 or 3*a*-2 transversely, a contact member 2*a*-34 or 3*a*-34 projecting from the block 2*a*-2 or 3*a*-2, and a transverse stopper 2*a*-35 or 3*a*-35 attached to the unit body 2*a*-1 or 3*a*-1 on which the contact member 2*a*-34 or 3*a*-34 is adapted to abut, as shown in FIG. 7, whereby the transverse positioning of the block 2*a*-2 or 3*a*-2 is effected.

Figure 7:
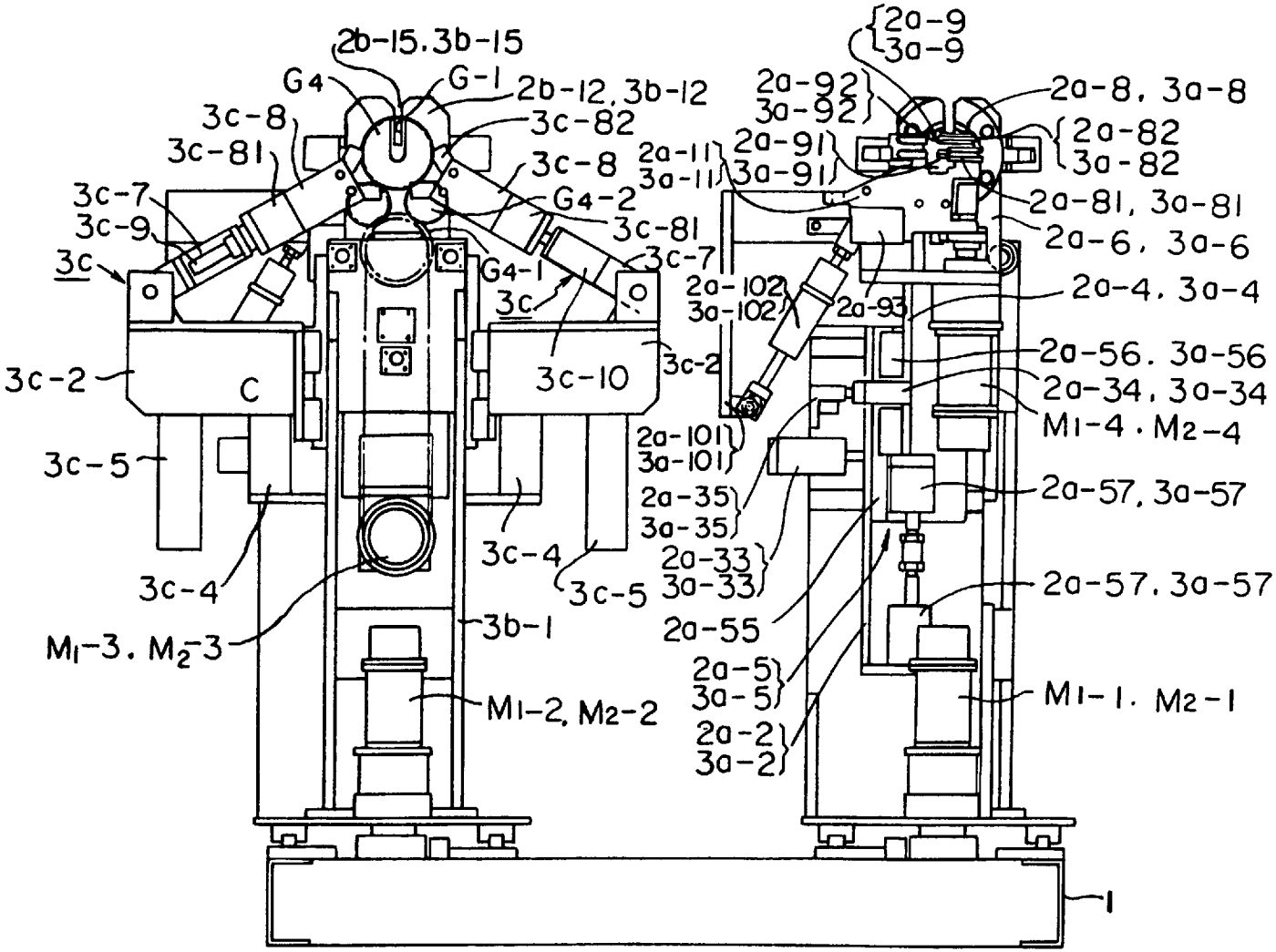
FIG. 7 is a front elevational view of the apparatus.
Figure 8:
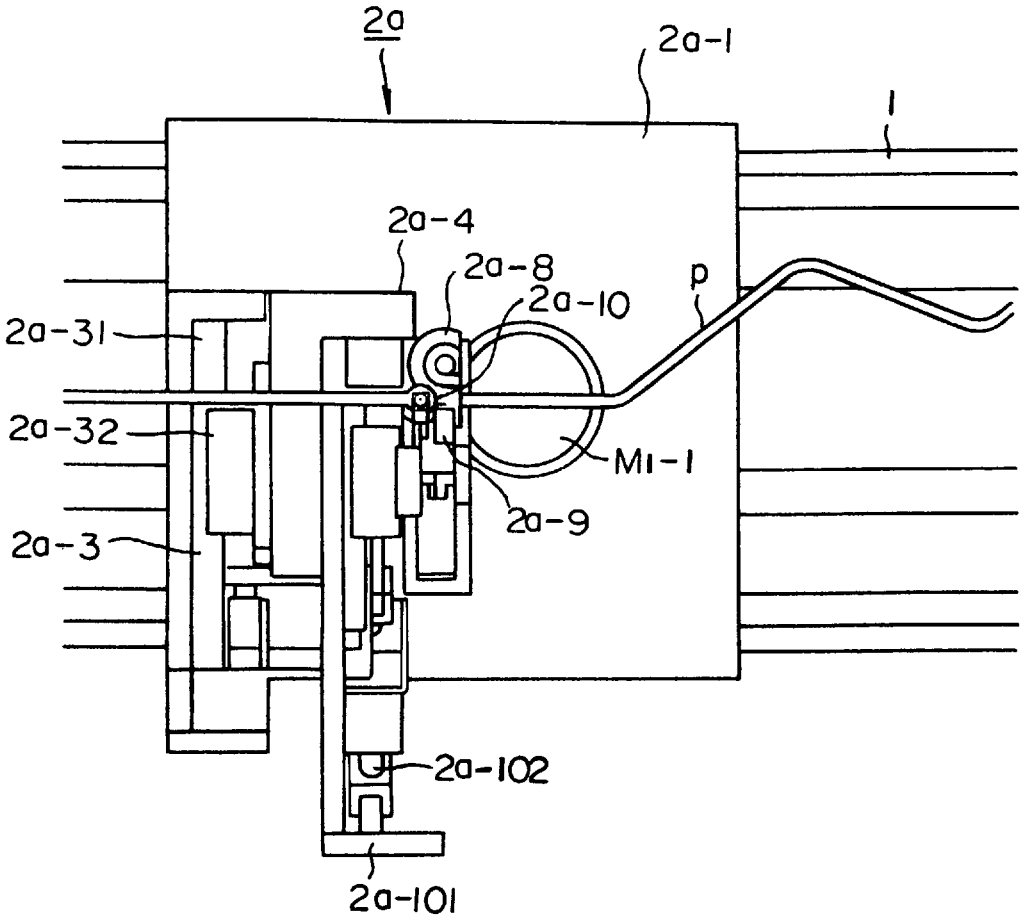
FIG. 8 is an enlarged top plan view of the bending Unit in the bending device in the first row as shown ni FIG. 3.

The vertical positioning mechanism 2*a*-5 or 3*a*-5 for the vertically movable block 2*a*-4 or 3*a*-4 comprises a vertical rail 2*a*-55 or 3*a*-55 formed on the horizontally movable block 2*a*-2 or 3*a*-2, a protrusion 2*a*-56 or 3*a*-56 formed on the vertically movable block 2*a*-4 or 3*a*-4 and fitted slidably on the rail 2*a*-55 or 3*a*-55, and a vertical positioning cylinder 2*a*-57 or 3*a*-57 mounted on the horizontally movable block 2*a*-2 or 3*a*-2 for moving the vertically movable block 2*a*-4 or 3*a*-4 vertically, as shown in FIG. 7.

The bending die 2*a*-8 or 3*a*-8 comprises two die rolls 2*a*-81 and 2*a*-82, or 3*a*-81 and 3*a*-82 having different diameters, and is mounted coaxially on the top of a rotor 2*a*-11 or 3*a*-11 which is rotatable about an axis parallel to the axis of rotation of a bending motor $M_1$-4 or $M_2$-4 installed vertically on the vertically movable block 2*a*-4 or 3*a*-4. The rotor 2*a*-11 or 3*a*-11 is rotated by the motor $M_1$-4 or $M_2$-4, a rack 2*a*-12 and a pinion 3*a*-12.

The clamping die 2*a*-9 or 3*a*-9 includes clamping plates 2*a*-93 and 2*a*-92, or 3*a*-93 and 3*a*-92 corresponding to the die rolls 2*a*-81 and 2*a*-82, or 3*a*-81 and 3*a*-82 of the bending die 2*a*-8 or 3*a*-8, and is so mounted by a link mechanism embedded in the rotor 2*a*-11 or 3*a*-11, though not shown, as to make an arcuate motion at right angles to the longitudinal axis of the pipe P. It is movable by a clamping cylinder 2*a*-81 or 3*a*-11 attached to the rotor 2*a*-11 or 3*a*-11.

The pressure die 2*a*-10 or 3*a*-10 is provided for receiving a reaction force from the pipe P during its bending. A pressure cylinder 2*a*-102 or 3*a*-102 is mounted in an inclined form on an L-shaped bracket 2*a*-101 or 3*a*-101 projecting from the vertically movable block 2*a*-4 or 3*a*-4, and applies pressure to the pipe P clamped by the bending and clamping dies 2*a*-8 and 2*a*-9, or 3*a*-8 and 3*a*-9.

No. 1 and No. 2 twisting units 2*b* and 3*b* are mounted on the platform 1 on which No. 1 and No. 2 bending units 2*a* and 3*a* are mounted, and are movable along the logitudinal axis of the pipe P. They are each movable back and forth by a motor $M_1$-2 or $M_2$-2 mounted on a unit body 2*b*-1 or 3*b*-1, and a rack and pinion mechanism. A chuck supporting plate 2*b*-12 or 3*b*-12 is mounted on a fixed plate 2*b*-11 or 3*b*-11 secured to the top of the unit body 2*b*-1 or 3*b*-1, and is movable back and forth by a return cylinder 2*b*-13 or 3*b*-13. The chuck supporting plate 2*b*-12 or 3*b*-12 is provided with a guide rod 2*b*-14 or 3*b*-14. While each twisting unit 2*b* or 3*b* is moved toward the bending unit 2*a* or 3*a* by a distance corresponding to the movement of the pipe P which occurs when it is bent, the distance by which it is moved differs with the material and diameter of the pipe P, and the chuck supporting plate 2*b*-12 or 3*b*-12 is, therefore, movable back and forth for absorbing any such difference. Accordingly, the return cylinder 2*b*-13 or 3*b*-13 is released when the pipe is bent, and when the bending device is positioned, it is returned to its original position to fix the chuck supporting plate 2*b*-12 or 3*b*-12 in position.

Figure 9:
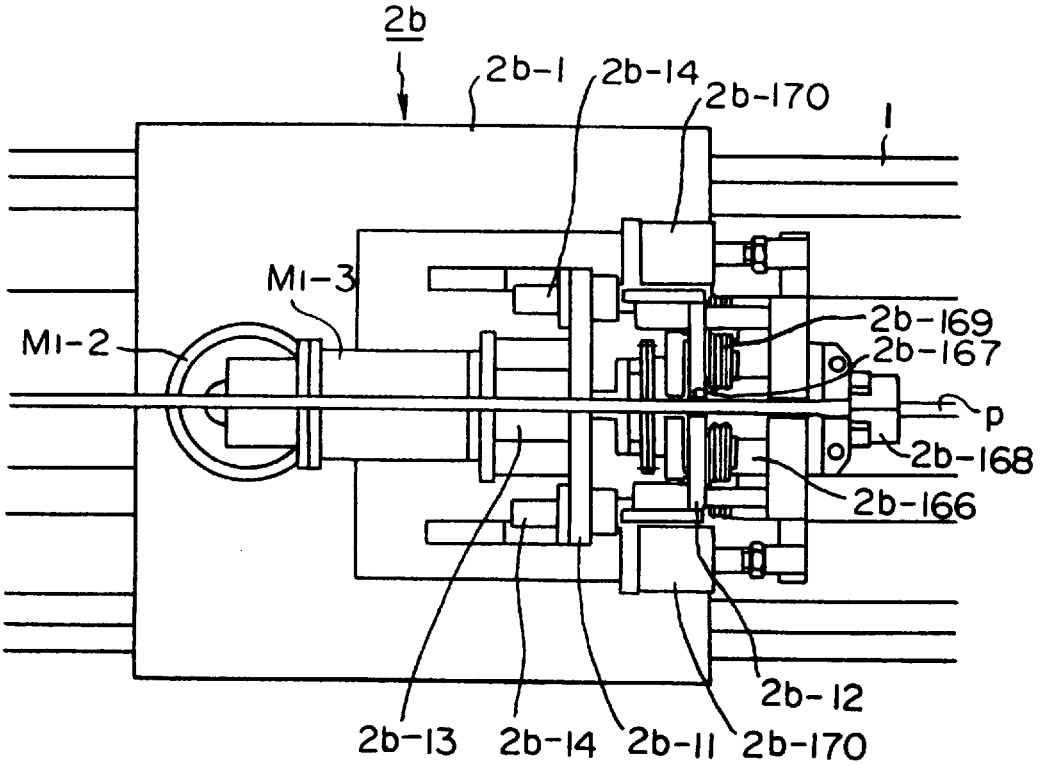
FIG. 9 is an enlarged top plan view of the twisting unit in the bending device in the first row.
Figure 10:
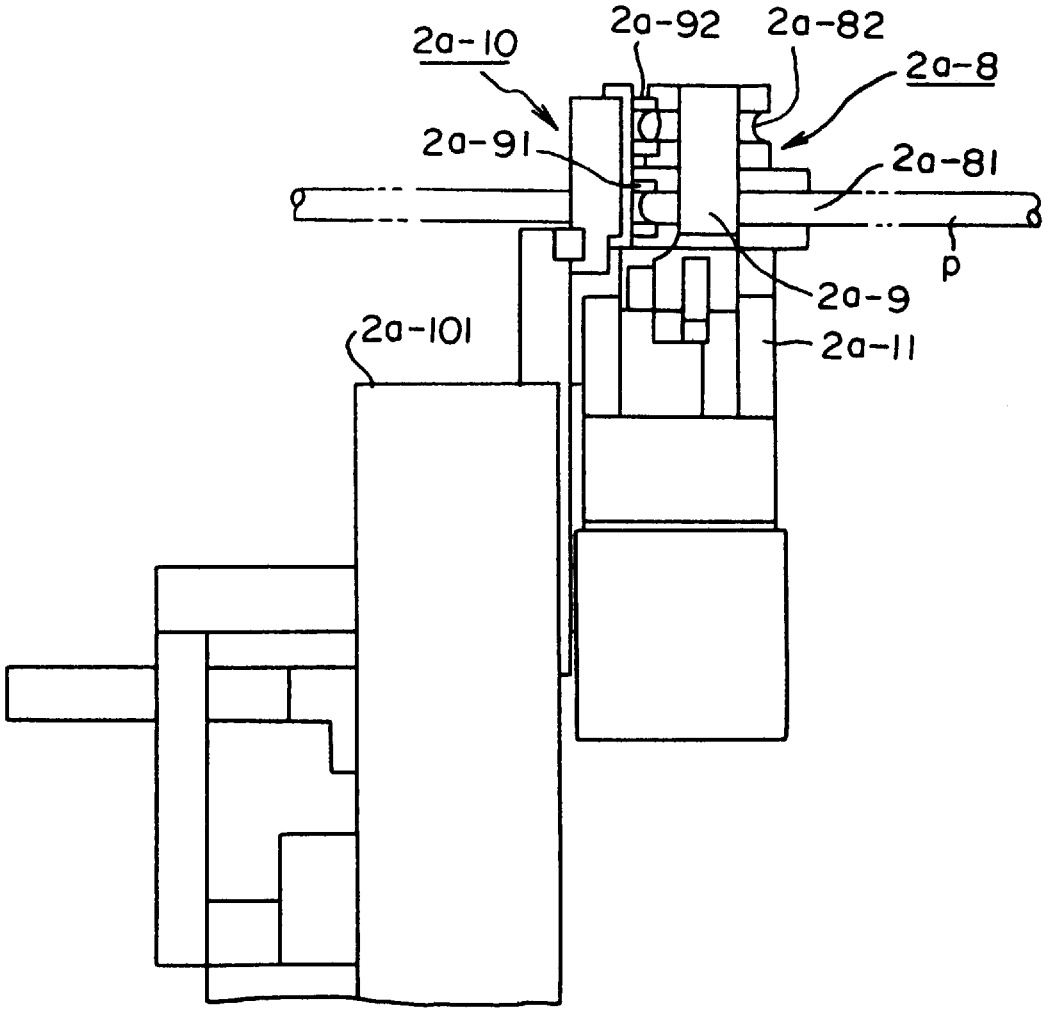
FIG. 10 is an enlarged side elevational view of a part of the bending unit in the bending device shown in FIG. 5.

The chuck supporting plate 2*b*-12 or 3*b*-12 has a U-shaped pipe engaging recess 2*b*-15 or 3*b*-15 formed at its top to have the pipe P engaged therein, and a chuck device 2*b*-16 or 3*b*-16 is rotatably supported behind it. The chuck device 2*b*-16 or 3*b*-16 comprises a circular rotor 2*b*-166 or 3*b*-166 supported rotatably by the chuck supporting plate 2*b*-12 or 3*b*-12 and having a pipe engaging recess 2*b*-167 or 3*b*-167 similar to that of the chuck supporting plate 2*b*-12 or 3*b*-12, and a chuck mechanism 2*b*-168 or 3*b*-168 fitted in the rotor 2*b*-166 or 3*b*-166 so as to be opened and closed by a mechanism for back and forth movement composed of a pair of cylinders 2b-170 or 3b-170, as shown in FIG. 9. A guide roller 2b-169 or 3b-169 is provided for the rotor 2b-166 or 3b-166.

Figure 11:
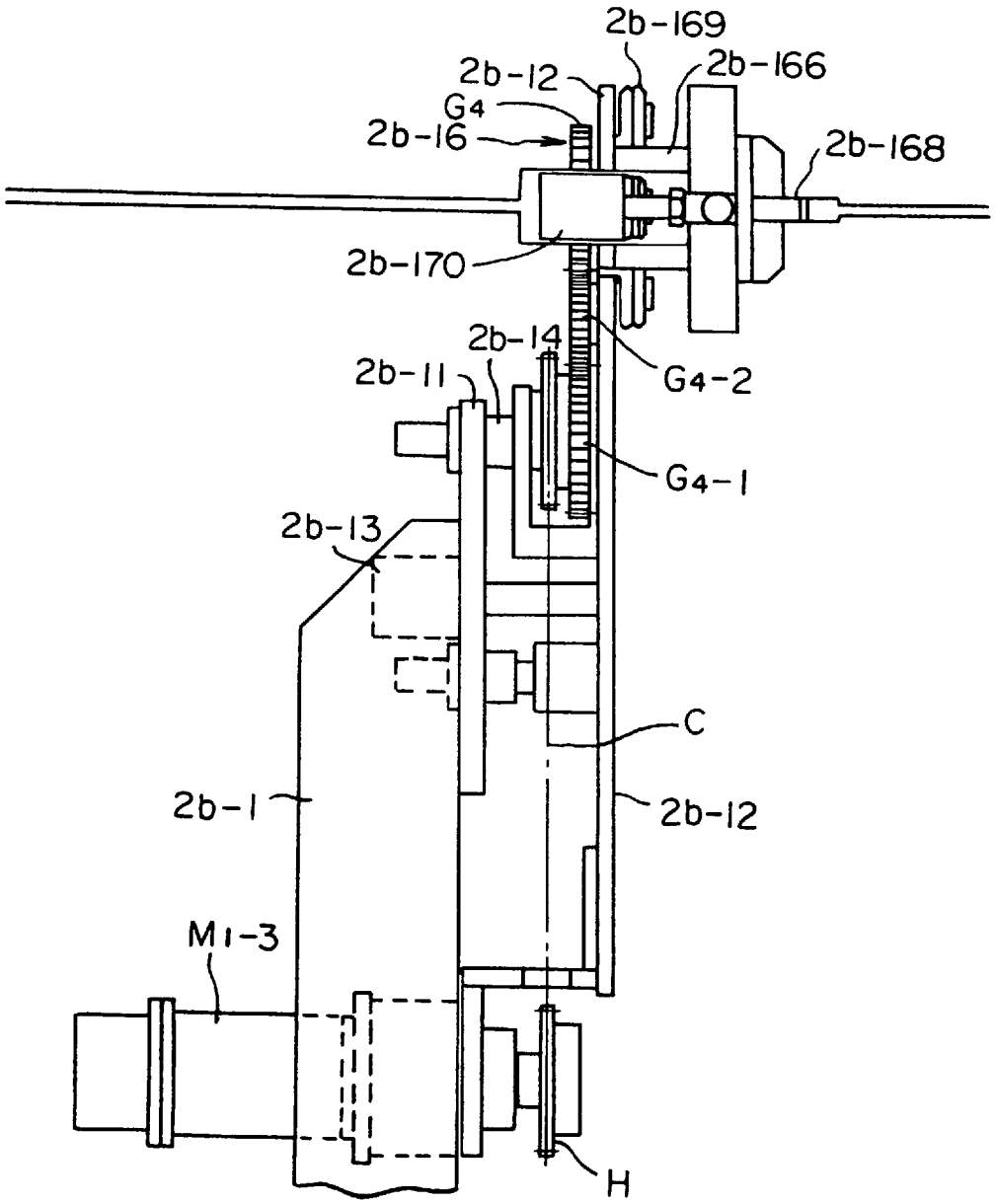
FIG. 11 is an enlarged side elevational view of a part of the twisting unit in the bending device shown in FIG. 5.
Figure 12:
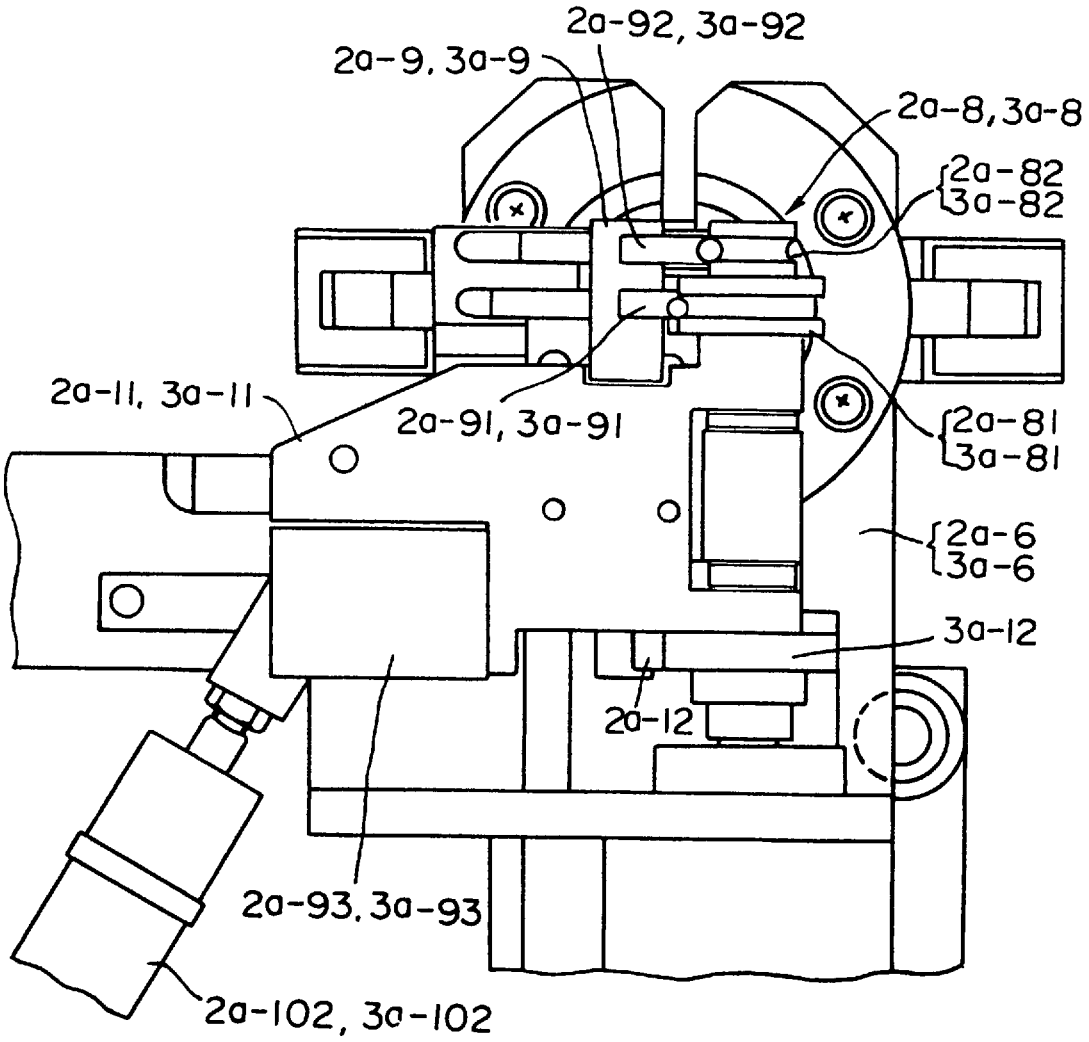
FIG. 12 is an enlarged front elevational view of a part of the bending unit in the bending device shown in FIG. 7.

A twisting motor $M_1$-3 or $M_2$-3 is provided at the bottom of the chuck supporting plate 2b-12 or 3b-12 for selecting the angle of rotation of the chuck device 2b-16 or 3b-16, or the direction in which the pipe is to be bent. The chuck device 2b-16 comprises a twisting gear $G_4$, a gear $G_4$-1 supported on the chuck supporting plate 2b-12 or 3b-12 rotatably by the twisting motor $M_1$-3 or $M_2$-3, a sprocket H and a chain C, and a pair of gears $G_4$-2 which transmit the rotation of the gear $G_4$-1 to the gear $G_4$, as shown in FIGS. 7 and 11. The twisting gear $G_4$ has a pipe engaging recess G-1 similar to the pipe engaging recess 2b-15 or 3b-15 of the chuck supporting plate 2b-12 or 3b-12, and the pipe engaging recess 2b-167 or 3b-167 of the rotor 2b-166 or 3b-166, as shown in FIG. 7.

Figure 13:
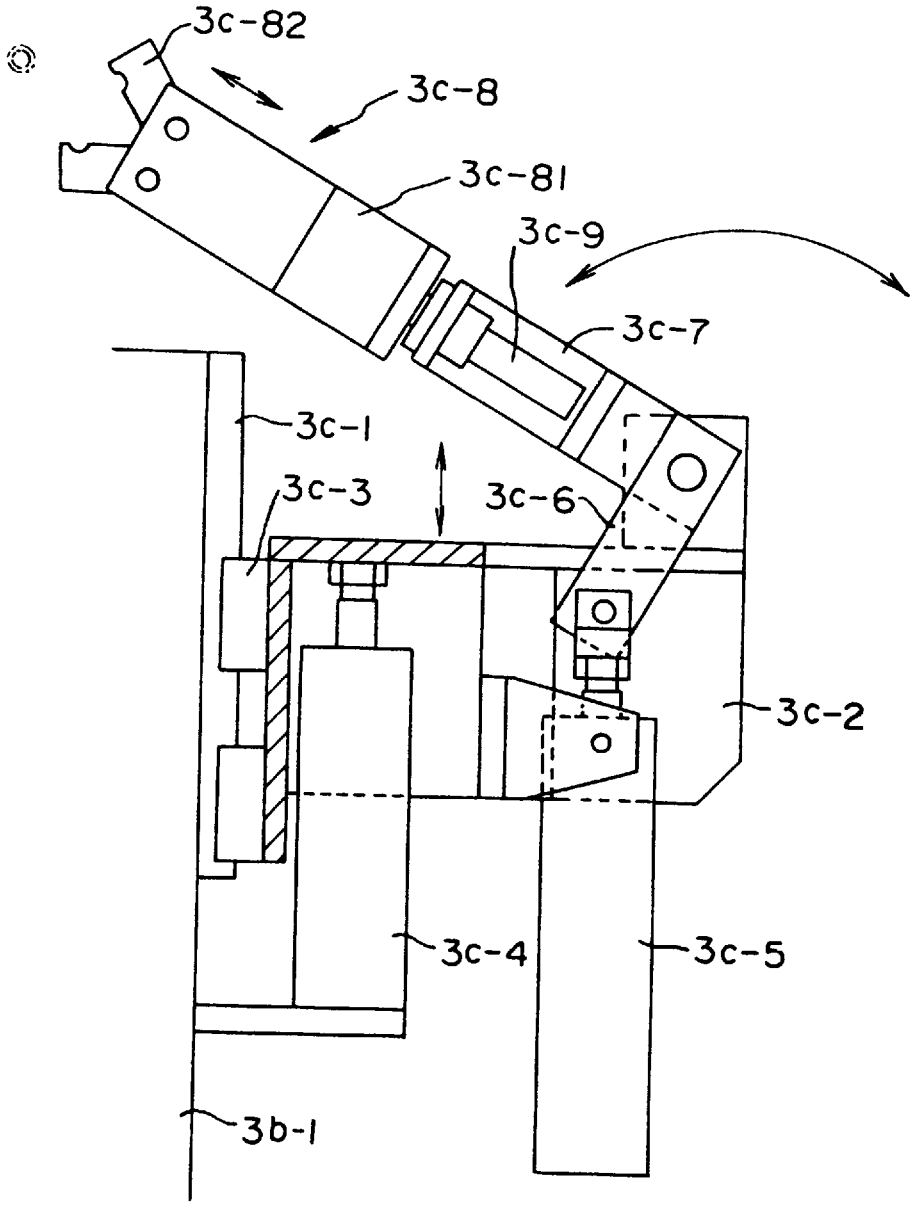
FIG. 13 is an enlarged front elevational view of a part of a pipe transfer device attached to the twisting unit in the bending device in the second row.
Figure 14:
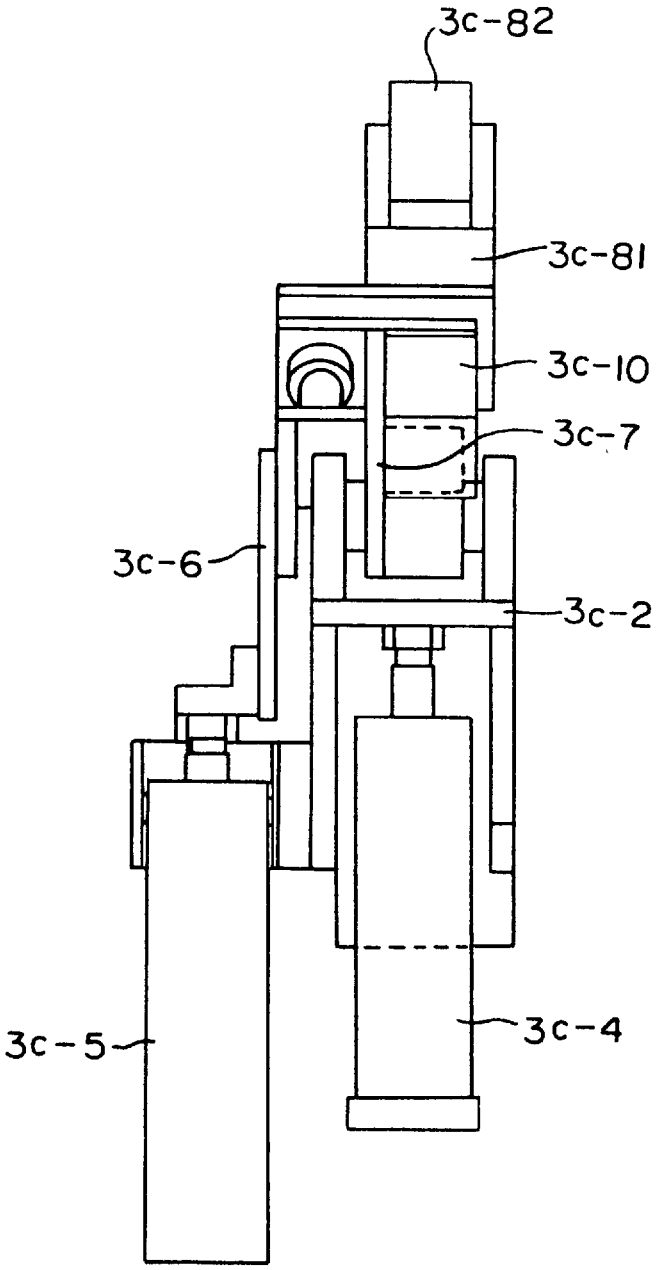
FIG. 14 is a side elevational view of the pipe transfer device shown in FIG. 13.

The pipe transfer device 3c carried on No. 2 twisting unit 3b comprises a pair of vertically movable stands 3c-2 having protrusions 3c-3 fitted vertically slidably on a pair of vertical guides 3c-1 provided on both sides, respectively, of the unit body 3b-1, and supported by a pair of vertical cylinders 3c-4 mounted on both sides of the unit body 3b-1, a pair of arms 3c-7 each connected rotatably to the end of one of the stands 3c-2, and so connected by a link 3c-6 to a rotating cylinder 3c-5mounted to the stand 3c-2 as to be rotatable at right angles to the longitudinal axis of the pipe P, a chuck device 3c-8 attached to the distal end of each arm 3c-7, a back and forth cylinder 3c-10 for the back and forth movement of each chuck 3c-8, and a guide rod 3c-9 for guiding such back and forth movement, as shown in FIGS. 7 and 13. Each chuck device 3c-8 has a set of clamp pawls 3c-82 which are opened and closed by a chuck cylinder 3c-81 for holding the pipe P.

When the pipe transfer device 3c is operated, the vertically movable stands 3c-2 are vertically moved by the vertical cylinders 3c-4 on both sides of the unit body 3b-1, and the chuck devices 3c-8 are rotated by the rotating cylinders 3c-5 mounted to the stands 3c-2. For the convenience of explanation, the vertical cylinders 3c-4 will be referred to as cylinders for the vertical movement of chucks, the rotating cylinders 3c-5 as cylinders for chuck age rotation, and the back and forth cylinders 3c-10 as cylinders for the back and forth movement of chucks.

Figure 1:
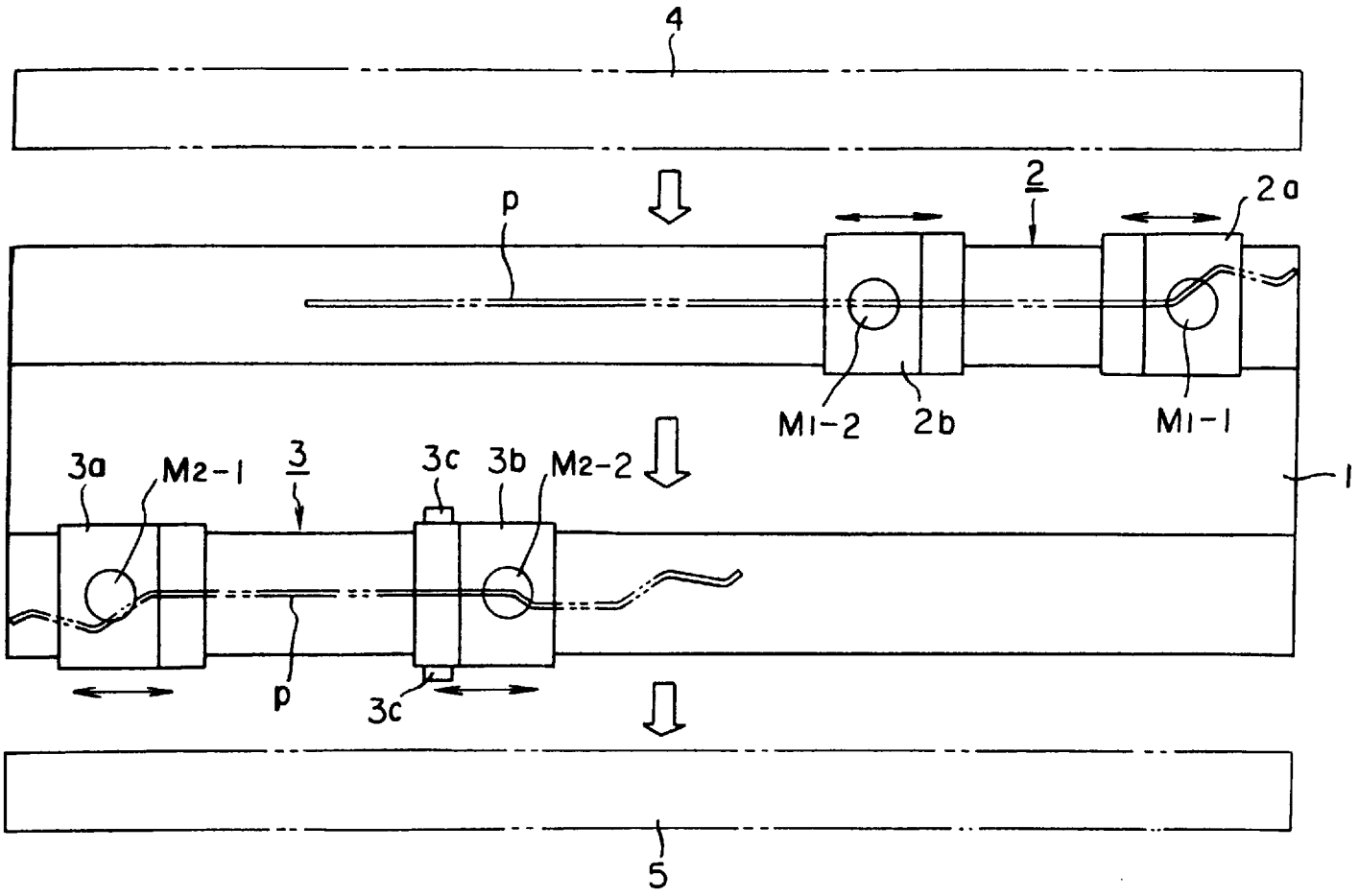
FIG. 1 is a schematic top plan view of a two-row pipe bending apparatus embodying this invention.
Figure 2:
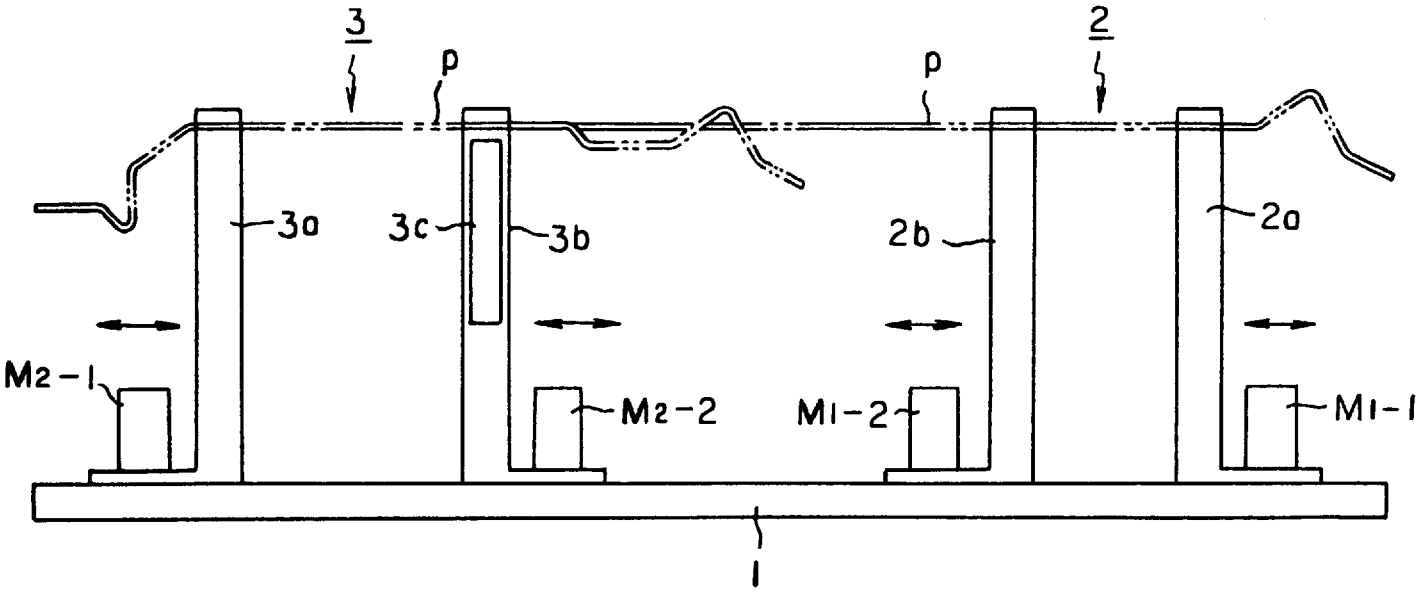
FIG. 2 is a schematic side elevational view of the apparatus shown in FIG. 1.
Figure 3:
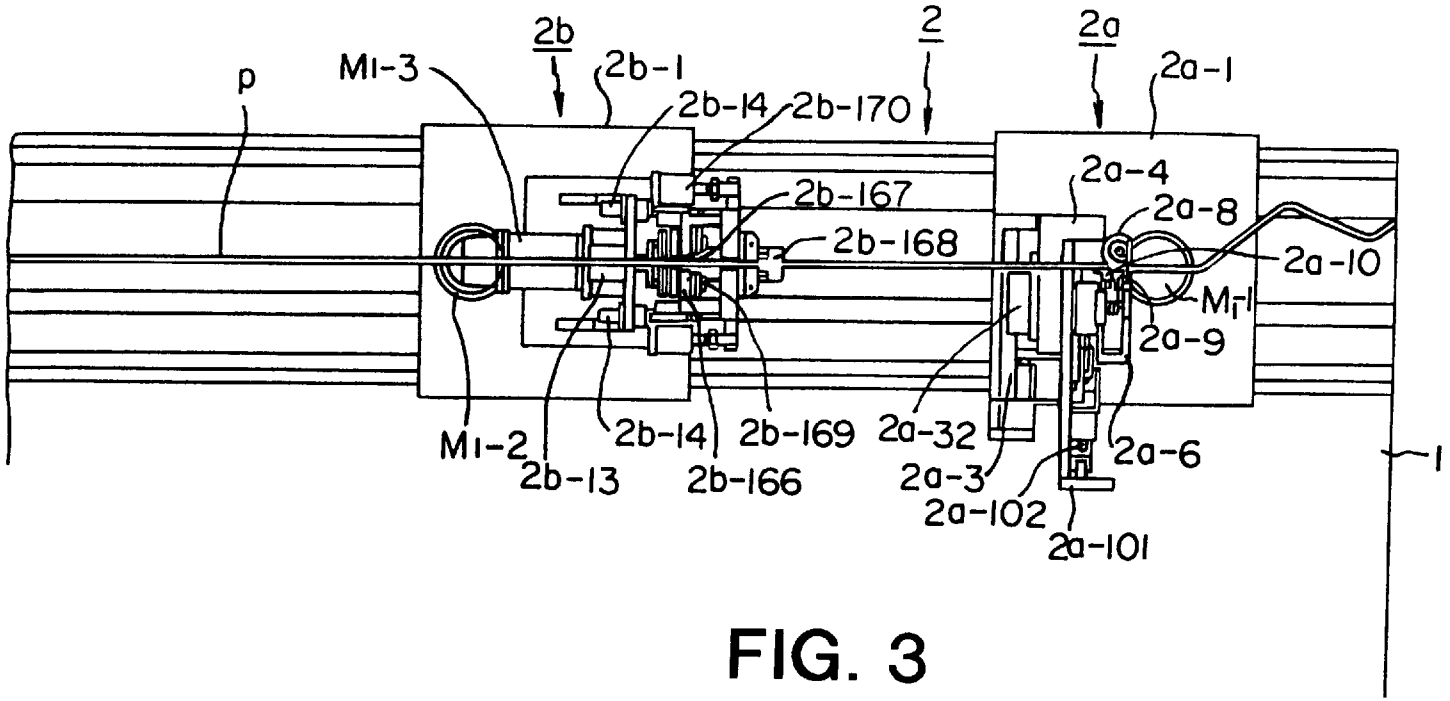
FIG. 3 is a top plan view of the pipe bending device in the first row of the apparatus shown in FIG. 1.
Figure 4:
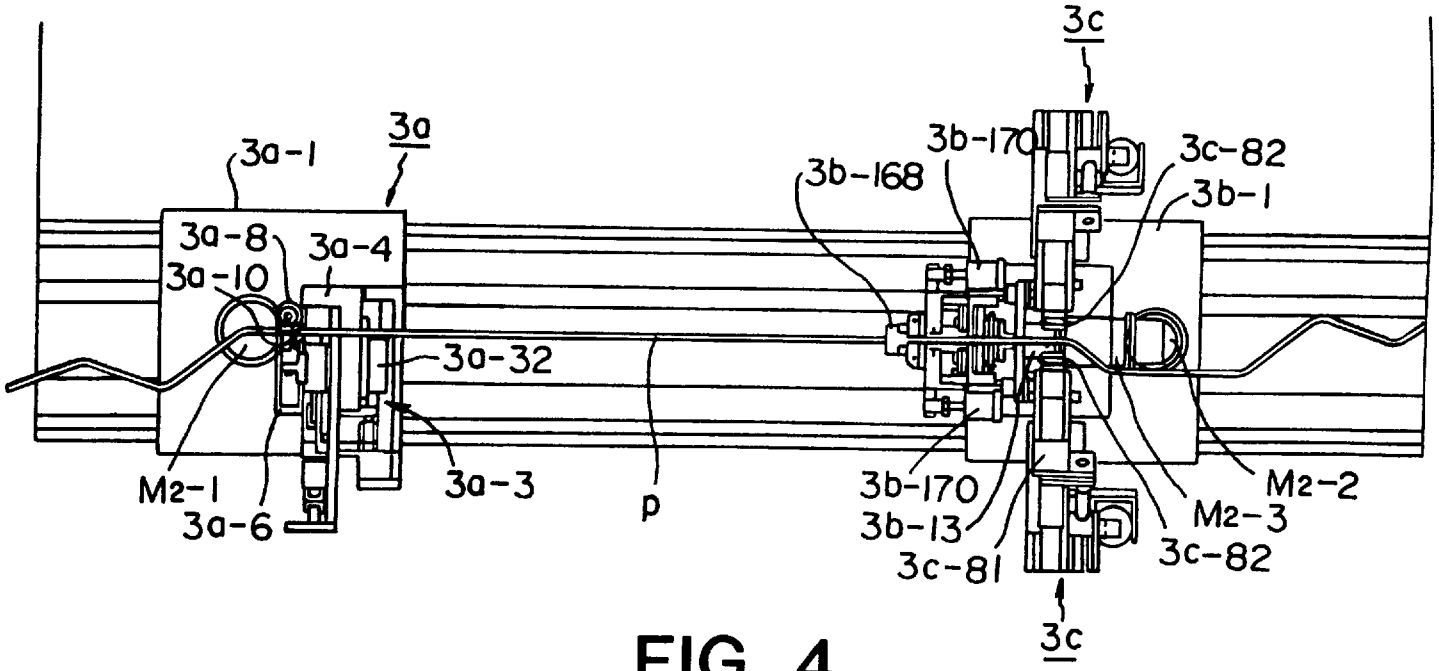
FIG. 4 is a t op plan view of the pipe bending device in the second row of the apparatus shown in FIG. 1.

Referring now to the operation of the apparatus as described above, the pipe P to be bent is first fed from a pipe feeding device 4 to the pipe bending device 2 in the first row, as shown in FIG. 1, after No. 1 bending and twisting units 2a and 2b have been moved in an appropriate direction on the platform 1 by the motors $M_1$-1 and $M_1$-2, and rack and pinion mechanisms. The pipe P is fitted in No. 1 bending unit 2a, and the pipe engaging recesses 2b-15, 2b-167 and G-1 of the chuck supporting plate 2b-12, rotor 2b-166 and twisting gear $G_4$, respectively, in No. 1 twisting unit 2b. The pipe P is clamped by the chuck device 2b-16 in No. 1 twisting unit 2b, and rotated by the motor $M_1$-3 in the direction in which it is to be bent. The bending die 2a-8 which is suitable for the shape in which the pipe P is to be bent is selected by the horizontal and vertical positioning mechanisms 2a-3 and 2a-5 in No. 1 bending unit 2a, and the pipe P is clamped by the clamp cylinder 2a-93.

After the pipe P has been held by No. 1 bending and twisting units 2a and 2b close to one end thereof, the bending motor $M_1$-4 is driven to rotate the rotor 2a-11 by the predetermined bending angle, and the pipe P is bent close to one end thereof by the bending, clamping and pressure dies -2a-8, 2a-9 and 2a-10. When the pipe P is bent, its movement causes the twisting unit 2b to move toward the bending unit 2a and any difference in distance of its movement is absorbed by the movement of the chuck supporting plate 2b-12 which is possible if the return cylinder 2b-13 is released, though the chuck supporting plate 2b-12 also moves with the movement of No. 1 twisting unit 2b.

When its bending at a first point has been finished, the pipe P is released from the clamping action of No. 1 bending unit 2a, and is moved by No. 1 twisting unit 2b to the position in which its bending at a second point is to be carried out. Then, the operation as described above is repeated to bend the pipe P at a plurality of points close to one end thereof.

When the bending of the pipe P close to one end thereof has been finished by the pipe bending device 2 in the first row, the pipe transfer device 3c on No. 2 twisting unit 3b of the pipe bending device 3 in the second row is placed in operation, as described below. The cylinder 3c-5 for chuck rotation which is situated adjacent to the bending device 2 in the first row is actuated to rotate the corresponding arm 3c-7 toward the bending device 2 and stop it in an appropriate position. The cylinder 3c-10 for the back and forth movement of chuck is actuated to move the chuck device 3c-8 forward, so that the chuck device 3c-8 may hold the pipe P, whereupon the pipe P is released from the clamping action of No. 1 bending and twisting units 2a and 2b in the first row. The cylinder 3c-4 for the vertical movement of chuck is actuated to raise the vertically movable stand 3c-2 and thereby lift the pipe P from the bending and twisting units 2a and 2b in the first row. The cylinder 3c-5 is actuated again to rotate the arm 3c-7 back toward the pipe bending device 3 in the second row.

The arm 3c-7 is rotated to locate the pipe P exactly above No. 2 bending unit 3, and the pipe engaging recesses 3b-15, 3b-167 and G-1 of the chuck supporting plate 3b-12, rotor 3b-166 and twisting gear $G_4$, respectively, in the second row. Then, the cylinder 3c-4 for the vertical movement of chuck is actuated to lower the vertically movable stand 3c-2, so that the pipe P may be fitted in No. 2 bending unit 3a and the pipe engaging recesses 3b-15, 3b-167 and G-1 of No. 2 twisting unit 3b to be bent close to the opposite end thereof.

The pipe P is clamped by the chuck device 3b-16 in No. 2 twisting unit 3b, whereupon the chuck device 3c-8 ceases to hold the pipe P and is moved back by the cylinder 3c-10. The pipe P is rotated by the twisting motor $M_2$-3 in the direction in which it is to be bent. The bending die 3a-8 which is suitable for the shape in which the pipe P is to be bent is selected by the horizontal and vertical positioning mechanisms 3a-3 and 3a-5 in No. 2 bending unit 3a, and the pipe P is clamped by th clamp cylinder 3a-93.

After the pipe P has been held by No. 2 bending and twisting units 3a and 3b close to the other end thereof, the bending motor $M_2$-4 is driven to rotate the rotor 3a-11 by the predetermined bending angle and the pipe P is bent close to the other end thereof by the bending, clamping and pressure dies 3a-8, 3a-9 and 3a-10. When the pipe P is bent, its movement causes the twisting unit 3b to move toward the bending unit 3a and any difference in distance of its movement is absorbed by the movement of the chuck supporting plate 3b-12 which is possible if the return cylinder 3b-13 is released.

When the bending of the pipe P by the bending device 3 in the second row has been finished to complete its bending, the pipe transfer device 3c on the discharge side of No. 2 twisting unit 3*b* which is remote from the bending device 2 in the first row is placed in operation. The corresponding cylinder 3*c*-5 for chuck rotation is actuated to rotate the arm 3*c*-7 toward the pipe P and stop it in an appropriate position. The cylinder 3*c*-10 for the back and forth movement of chuck is actuated to move the chuck device 3*c*-8 forward, so that the chuck device 3*c*-8 may hold the pipe P. whereupon the pipe P is released from the clamping action of No. 2 bending and twisting units 3*a* and 3*b* in the second row. The cylinder 3*c*-4 for the vertical movement of chuck is actuated to raise the vertically movable stand 3*c*-2 and thereby lift the pipe P from the bending and twisting units 3*a* and 3*b* in the second row. The cylinder 3*c*-5 is actuated again to rotate the arm 3*c*-7 back toward a product stock device 5 (FIG. 1), and the pipe P is delivered to it.

The operation of the apparatus as described above is repeated from one pipe to another for bending each pipe at a plurality of points close to both ends thereof.

The apparatus of this invention can be used to bend a pipe in a fully automatic operation by employing an automatic control system not shown, and inputting to it the necessary information including the points at which the pipe is to be bent, the angle by which it is to be twisted and bent at each point, and the distance of movement of each bending or twisting unit.

What is claimed is:

1. A multi-row pipe bending apparatus comprising a plurality of rows of pipe bending devices, each of said bending devices comprising a pipe bending unit and a pipe twisting unit, the pipe bending unit of each said pipe bending device having at least one bending die, and clamping and pressure dies for securing to said bending die a pipe to be bent, said bending unit of each said bending device being movable longitudinally of said pipe, the pipe twisting unit of each said pipe bending device having a twisting plate with an opening for holding said pipe and being rotatable with a predetermined twisting angle about the longitudinal axis of said pipe for moving said pipe to a position conforming to a shape into which said pipe is to be bent, said twisting unit of each said bending device being movable longitudinally of said pipe, each of said rows further including a pipe transfer device for transferring said pipe to another row, so that said pipe may be bent close to one end thereof in one row, and close to the other end in another row.

2. An apparatus as set forth in claim 1, wherein said bending unit has a plurality of bending dies used selectively in accordance with the shape into which said pipe is to be bent, and further includes a mechanism for the vertical positioning of any of said bending dies and a mechanism for the horizontal positioning thereof.

3. An apparatus as set forth in claim 2, wherein each of said bending dies comprises a plurality of die rolls.

4. An apparatus as set forth in claim 2, wherein said twisting unit includes a chuck supporting plate which is movable back and forth for absorbing any difference that may occur to the distance of movement of said pipe when it is bent.

5. An apparatus as set forth in claim 1, wherein said bending die, or each of said bending dies comprises a plurality of die rolls.

6. An apparatus as set forth in claim 1, wherein said twisting unit includes a chuck supporting plate which is movable back and forth for absorbing any difference that may occur to the distance of movement of said pipe when it is bent.

7. An apparatus as set forth in claim 1, wherein the pipe has opposed first and second ends, a first of said pipe bending device having the pipe bending unit thereof disposed between the pipe twisting unit and the first end of the pipe and at least a second of the pipe bending devices having the pipe bending unit thereof disposed between the pipe twisting unit and the second end of the pipe for enabling bending of the pipe in proximity to the opposed first and second ends thereof.

8. A multi-row pipe bending apparatus comprising a plurality of rows of pipe bending devices each comprising a pipe bending unit having at least one bending die, and clamping and pressure dies for securing to said bending die a pipe to be bent, said bending unit being movable longitudinally of said pipe, and a pipe twisting unit having a twisting plate with an opening for holding said pipe, said twisting plate being rotatable with a predetermined twisting angle about the longitudinal axis of said pipe for moving said pipe to a position conforming to a shape into which said pipe is to be bent, each of said rows further including a pipe transfer device for transferring said pipe to another row, so that said pipe may be bent close to one end thereof in one row and close to the other end in another row, said pipe transfer device comprising a pair of vertically movable stands fitted vertically slidably on a pair of vertical guides provided on both sides, respectively, of said twisting unit, and supported by a pair of vertical cylinders mounted on both sides of said twisting unit, a pair of arms each connected rotatably to the end of one of said stands, and so connected by a link to a rotating cylinder mounted to said one stand as to be rotatable at right angles to the longitudinal axis of said pipe, a chuck device attached to the distal end of each of said arms, a cylinder for moving said chuck device back and forth, and a guide rod for guiding said movement of said chuck device, said chuck device having a set of clamp pawls which are opened and closed by a chuck cylinder for holding said pipe.

9. A multi-row pipe bending apparatus comprising a plurality of rows of pipe bending devices each comprising a pipe bending unit having a plurality of bending dies used selectively in accordance with a shape into which said pipe is to be bent, and further including a mechanism for vertical positioning of any of said bending dies and a mechanism for horizontal positioning thereof, each said pipe bending unit further having clamping and pressure dies for securing to said bending die a pipe to be bent, said bending unit being movable longitudinally of said pipe, and a pipe twisting unit having a twisting plate with an opening for holding said pipe, said twisting plate being rotatable with a predetermined twisting angle about the longitudinal axis of said pipe for moving said pipe to a position conforming to a shape into which said pipe is to be bent, each of said rows further including a pipe transfer device for transferring said pipe to another row, so that said pipe may be bent close to one end thereof in one row and close to the other end in another row, said pipe transfer device comprising a pair of vertically movable stands fitted vertically slidably on a pair of vertical guides provided on both sides, respectively, of said twisting unit, and supported by a pair of vertical cylinders mounted on both sides of said twisting unit, a pair of arms each connected rotatably to the end of one of said stands, and so connected by a link to a rotating cylinder mounted to said one stand as to be rotatable at right angles to the longitudinal axis of said pipe, a chuck device attached to the distal end of each of said arms, a cylinder for moving said chuck device back and forth, and a guide rod for guiding said movement of said chuck device, said chuck device having a set of clamp pawls which are opened and closed by a chuck cylinder for holding said pipe.

* * * * *